US005351668A

United States Patent [19]

Gatellier

[11] Patent Number: 5,351,668

[45] Date of Patent: Oct. 4, 1994

[54] PROCESS AND DEVICE FOR FAVORING FUEL VAPORIZATION IN AN INTERNAL-COMBUSTION ENGINE

[75] Inventor: Bertrand Gatellier, Boulogne, France

[73] Assignee: Institut Francais du Petrole, Rueil Malmaison Cedex, France

[21] Appl. No.: 978,326

[22] Filed: Nov. 18, 1992

[30] Foreign Application Priority Data

Nov. 18, 1991 [FR] France ..... 91 14170

[51] Int. Cl.[5] ..... F02M 25/07

[52] U.S. Cl. ..... 123/568

[58] Field of Search ..... 123/432, 568, 569, 571, 123/585

[56] References Cited

U.S. PATENT DOCUMENTS

| | | | |
|---|---|---|---|
| 3,416,503 | 12/1968 | High | 123/568 X |
| 3,498,274 | 3/1970 | Chapman | 123/568 |
| 3,980,056 | 9/1976 | Kraus | 123/568 X |
| 4,233,946 | 11/1980 | Yorioka et al. | 123/568 |
| 4,271,801 | 6/1981 | Yamakawa | 123/432 |
| 4,361,126 | 11/1982 | Knapp et al. | 123/568 X |
| 4,463,740 | 8/1984 | Sagisaka et al. | 123/568 |
| 4,475,524 | 10/1984 | Eckert et al. | 123/568 |
| 5,056,309 | 10/1991 | Linder et al. | 123/568 X |
| 5,168,839 | 12/1992 | Hitomi et al. | 123/432 |

FOREIGN PATENT DOCUMENTS

| | | |
|---|---|---|
| 459374 | 12/1991 | European Pat. Off. . |
| 4009923 | 10/1991 | Fed. Rep. of Germany . |
| 2073320 | 10/1981 | United Kingdom . |
| PCT/DE88/-00314 | 1/1989 | World Int. Prop. O. . |

OTHER PUBLICATIONS

Patent Abstracts of Japan vol. 10 No. 299 (M-524) [2355]Oct. 11, 1986.

*Primary Examiner*—Willis R. Wolfe

*Attorney, Agent, or Firm*—Antonelli, Terry, Stout & Kraus

[57] ABSTRACT

The invention relates to a process and a device for improving vaporization of a fuel injected into an internal-combustion engine so as to decrease harmful discharges in the exhaust gases . The engine comprises at least one cylinder (1) with an inlet pipe (6) , an exhaust pipe (4) , a secondary conduit (7) provided with a plug connecting for example the two pipes together so as to recycle towards the inlet pipe a fraction of the waste gases richer in unburned hydrocarbons. The process implemented here essentially consists in placing a fuel injector (9) in proximity to the intersection of inlet pipe (6) and secondary conduit (7) so as to take advantage of the high temperature of the recycled gases to vaporize fuel better and drive it towards the combustion chamber.

12 Claims, 2 Drawing Sheets

PROCESS AND DEVICE FOR FAVORING FUEL VAPORIZATION IN AN INTERNAL-COMBUSTION ENGINE

BACKGROUND OF THE INVENTION

The present invention relates to a process and a device for improving the yield of a spark-ignition and internal-combustion engine by favoring fuel vaporization during the intake phases.

The object of the searched improvement mainly consists in reducing the harmful components in the exhaust gases of the cylinders and notably nitrogen oxides, as well as unburned hydrocarbons.

Processes making it possible to reduce harmful discharges, whose basic principle consists in recycling part of the waste gases coming from the combustion chambers of an engine, are well-known. Recycling may be external, the waste gases being recycled through conduits connecting the exhaust pipes to the inlet pipes, under the control of valves for example, or internal under the effect of a particular valve timing or by means of additional valves, etc. The use of injection in engines to obtain a better control of the fuel mixture ratio leads to debasing the quality of the latter and to increasing unburned hydrocarbon discharges.

European patent application EP-A-484,206, for example, describes a process and a device enabling controlled recycling, as a function of the load, of a fraction of the waste gases collected in the exhaust pipe of an internal-combustion engine, so as to increase the engine yield and to reduce harmful discharges. To that effect, each combustion chamber is connected in a controlled way to the inlet pipe or the exhaust pipe through a secondary conduit opening into one or the other in close proximity to the inlet or exhaust valve. According to one embodiment, communication with the combustion chamber may be established by making the secondary conduit open in the latter by interposing a secondary valve and/or a control plug. According to another embodiment, the secondary conduit communicates the inlet pipe and the exhaust pipe in close proximity to their respective valves, communication being controlled by a valve or a plug interposed on this secondary conduit. This direct communication between the two pipes makes it possible to achieve a better proportioning of the reinjected fraction of waste gases which is richest in harmful discharges.

SUMMARY OF THE INVENTION

The object of the process in accordance with the invention is basically to favor fuel vaporization in a spark-ignition internal-combustion engine comprising at least one cylinder associated with a fuel mixture inlet pipe, an exhaust pipe and a secondary conduit associated with control means, making it possible to achieve a controlled recycling of a fraction of waste gas fraction during the intake phases.

The fuel vaporization is favored by directly injecting fuel in a flow of waste gases re-fed at each cycle via said secondary conduit, so as to take advantage of their high temperature to facilitate fuel vaporization.

Fuel injection is, for example, performed in the flow of waste gases escaping intermittently from each cylinder in the secondary conduit on the opening of a secondary control valve.

The fuel may also be injected into the flow of waste gases coming from the exhaust pipe connected to the inlet pipe through said secondary conduit.

According to a first implementation suited for an engine with several cylinders, a multipoint injection is achieved, with the fuel being injected into each inlet pipe of the engine, in a flow of waste gases coming from a corresponding secondary conduit.

In order to favor fuel injection in an engine having several cylinders, fuel may be injected in the waste gas flow coming from an exhaust manifold common to several cylinders, connected to each inlet pipe by a specific secondary conduit.

The fuel injection is preferably achieved sequentially for the duration of closing of each inlet valve.

In order to favor fuel injection in an engine having several cylinders, a single-point injection may also be performed, with the fuel being injected in the waste gas flow coming from an exhaust manifold common to several cylinders, and recycled in an inlet manifold common to several cylinders through a common secondary conduit.

The basic idea of the invention is to take advantage of the high temperature of the recycled waste gases to better vaporize the fuel. The fuel being injected in a time interval where a current of recycled warm waste gases coming from a secondary conduit, specific or not, circulates towards the combustion chambers, vaporization is much better than in the conventional instance where injection is achieved in a fresh air stream or possibly in a mixture comprising mainly fresh air to which is added a fraction of exhaust gases thus combustion and the yield of the engine are substantially improved.

The invention also relates to an implementing device for favoring fuel vaporization in an internal-combustion engine comprising at least one cylinder associated with a fuel mixture inlet pipe, an exhaust pipe and a secondary conduit associated with control means, making it possible to perform a controlled recycling of a waste gas fraction during the inlet phases. This device is remarkable in that it comprises fuel injection means arranged so that the injected fuel is directly in contact with the waste gases recycled by the secondary conduit.

In the case of an engine having several cylinders, the device comprises, for example, multipoint injection means, secondary conduits associated respectively with each cylinder, each of the conduits communicating towards its end with the corresponding inlet pipe being curved so that the recycled gas flow is directed towards inlet valve, with the injection means being arranged substantially at the level of the end of each secondary conduit.

According to one embodiment, each secondary conduit is laid-out so as to establish communication between an inlet pipe and an exhaust manifold for one or several cylinders.

According to another embodiment, each secondary conduit is, for example, laid-out so as to establish communication between an inlet pipe and the inside of a cylinder by a control valve.

When used for an multi-cylinder engine, the device may comprise, for example, single-point injection means and the secondary conduit is laid-out to establish communication between an exhaust manifold for one or several cylinders and an inlet manifold for one or several cylinders.

BRIEF DESCRIPTION OF THE DRAWINGS

Other features and advantages of the method and of the device according to the invention will be clear from reading the following description of embodiments given by way of non limitative example, with reference to the accompanying drawings in which.

DESCRIPTION OF THE PREFERRED EMBODIMENTS

Figure 1:
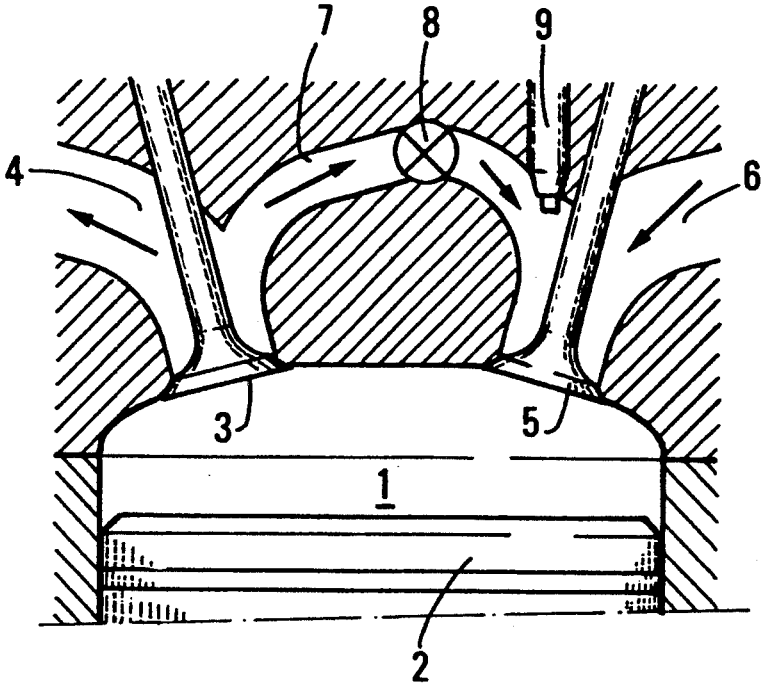
FIG. 1 shows a first embodiment with a separate secondary conduit connecting each inlet pipe and each corresponding exhaust pipe.
Figure 2:
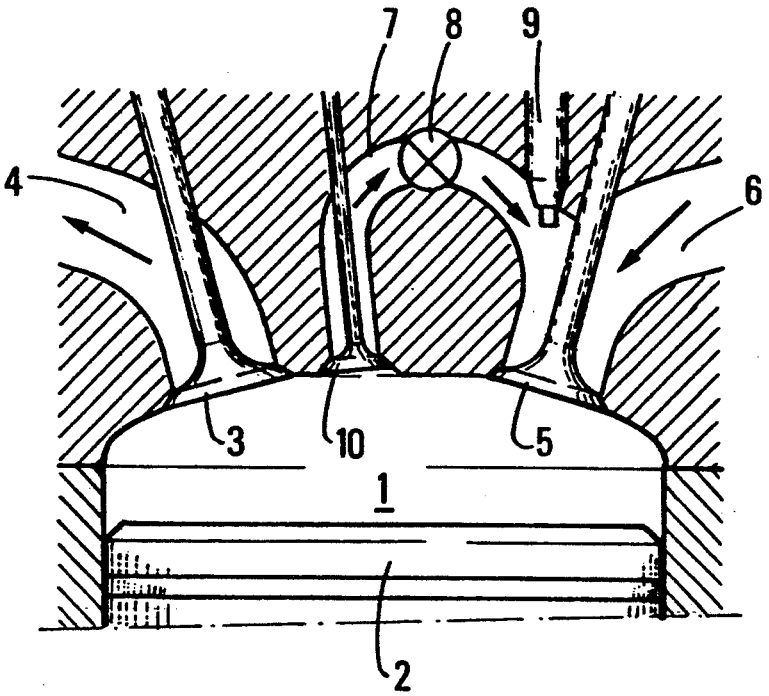
FIG. 2 shows a second embodiment where the secondary conduit communicates with the combustion chamber by means of a secondary valve.

FIGS. 1 and 2 show an application of the device to an engine comprising at least one cylinder 1 in which a piston 2 slides, which communicates through a valve 3 with an exhaust pipe 4. The cylinder also communicates by a cyclic-opening inlet valve 5 with an inlet pipe 6. Controls means of a well-known type, not shown here, such as cam lifters for example, are associated with the two valves 3 and 5.

According to the embodiment of FIG. 1, a secondary conduit 7 communicates each inlet pipe with the corresponding exhaust pipe. A control means such as a plug 8 is interposed on secondary conduit 7 so as to establish at each cycle an intermittent communication between the two pipes 4 and 6, as described in the above cited European patent application, so as to recycle a determined fraction of the gases burned during the previous cycle. To favor fuel vaporization during the intake phase, an injector 9 is arranged in the zone where secondary conduit 7 is connected to inlet pipe 6. The nozzle of injector 9 is placed, preferably, at the level of the intersection between conduit 7 and pipe 6, and the injection of fuel is synchronized with an opening of plug 8 so that the fuel is injected directly into the flow of warm waste gases coming out of secondary conduit 7. This conduit is advantageously curved so that the flow of waste gases carries the vaporized fuel along towards inlet valve 5.

Figure 3:
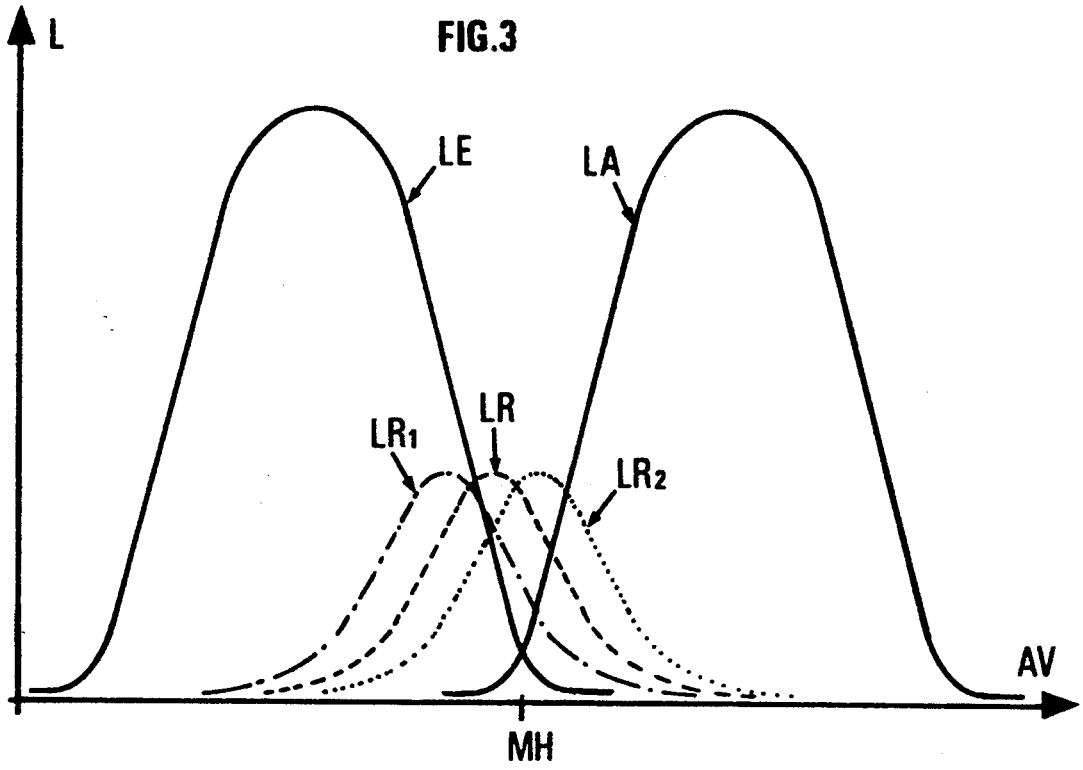
FIG. 3 shows, as a function of the angular position of the crankshaft, the respective lift curves of the exhaust valve, of the inlet valve and of the secondary valve, in the embodiment of FIG. 2.

According to the embodiment of FIG. 2, secondary conduit 7 communicates combustion chamber 1 with the inlet pipe, recycling of the waste gases being controlled through a secondary valve 10 whose lift time interval LR (FIG. 3) is intermediary between the exhaust LE and the intake LA time intervals, as described in the above noted European patent application. Appropriate control means make it possible to move this window LR more or less between two shifted positions LR1 and LR2 towards one or the other of the intake and exhaust time intervals LE and LA. A control plug 8 may also be interposed on the secondary conduit for the proportioning of the recycled waste gas fraction, into which the fuel is vaporized by the injector 9.

Figure 4:
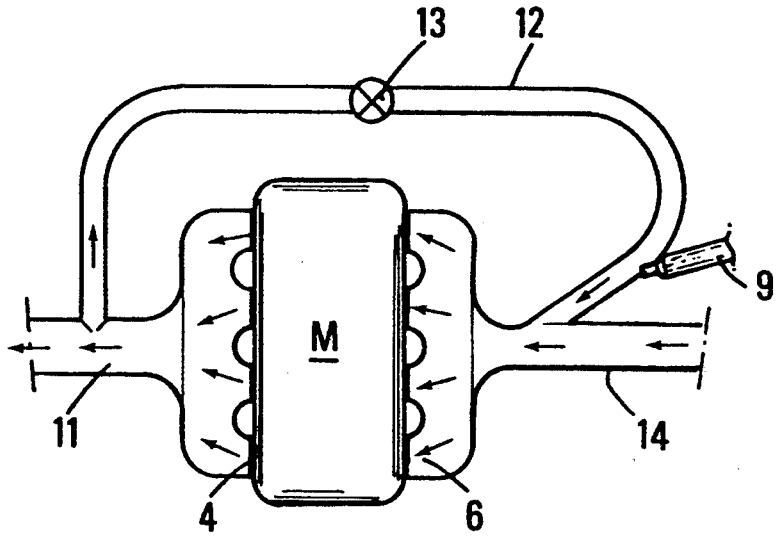
FIG. 4 shows a third embodiment within the scope of a single-point injection engine.

According to the embodiment of FIG. 4, the process in accordance with the invention is implemented within the scope of a single-point type injection. The waste gases helping towards a better fuel vaporization are taken from the exhaust manifold 11 of an engine M. They are introduced into inlet manifold 14 through a secondary conduit 12 provided with a controlled communication means 13 such as a plug or a check valve. Similarly, an injector 9 is arranged in proximity to the junction between inlet manifold 14 and conduit 12, so that the fuel is injected into the flow of recycled waste gases.

Without departing from the scope of the invention, the recycled gases flowing in through secondary conduits 7 may be collected no longer in each exhaust pipe 6 but in the exhaust manifold common to several cylinders of the engine.

I claim:

1. A device for favoring fuel vaporization in a multicylinder internal combustion engine, the device comprising fuel mixture inlet pipes, an exhaust pipe, multipoint injection means, and secondary conduits associated respectively with each cylinder, each one of said secondary conduits, toward an end thereof communicating with a corresponding inlet pipe, being curved so that a recycled gas flow is driven toward an inlet valve in the inlet pipe, wherein the injection means is arranged substantially at a level of said end of each of said secondary conduits.

2. A device as claimed in claim 1, wherein each secondary conduit is arranged so as to establish communication between the inlet pipe and an exhaust manifold for at least one cylinder.

3. A device as claimed in claim 1, wherein each secondary conduit is arranged so as to establish communication between an inlet pipe and an inside of a cylinder by a control valve.

4. A process for favoring fuel vaporization in a spark-ignition internal combustion engine comprising at least one cylinder provided with an inlet conduit controlled by an inlet valve for admission of a fuel mixture, an exhaust conduit controlled by an exhaust valve, a recycling secondary conduit for recycling waste gas, one end of said secondary conduit opening in said inlet conduit in a portion thereof near said inlet valve and an opposite end intermittently communicating with said cylinder, said secondary conduit having a short axial length for minimizing thermal losses of the recycled waste gas, and valve means in said secondary conduit for intermittently recycling waste gas, the process comprising the steps of:

controlling said valve means at each exhaust phase during a recycling time interval for directly recycling a selected fraction of the exhaust gas, and directly injecting fuel in said directly recycled waste gas fraction through injecting means positioned in said secondary conduit.

5. A process as claimed in claim 4, further comprising the step of controlling said valve means for directly recycling a fraction of exhaust waste gas when the temperature thereof is the highest.

6. A process as claimed in claim 4, further comprising the step of controlling said valve means for directly recycling a fraction of exhaust waste gas richer in harmful components.

7. A process as claimed in one of claims 4, 5, or 6, further comprising the step of controlling said valve means for selecting a determined recycling time interval in each exhaust phase and a determined fraction of exhaust gas escaping from the cylinder during said time interval.

8. A device for favoring fuel vaporization in an internal-combustion engine, the device comprising at least one cylinder associated with a fuel mixture inlet pipe, an exhaust pipe and a secondary conduit associated with control means, making it possible to perform, during the intake phases of the engine, a controlled recycling of a fraction of waste gas, and single-point injection means, wherein said secondary conduit is arranged so as to establish communication between an exhaust manifold for at least one cylinder and an inlet manifold for at least one cylinder, and wherein the injection means is directly placed in said secondary conduit.

9. A process as claimed in claim 8, wherein fuel is injected directly in the waste gas flow escaping intermittently from the at least one cylinder into the secondary conduit on the opening of a secondary control valve.

10. A process as claimed in claim 9, wherein fuel is injected directly into the flow of waste gas from an exhaust manifold common to several cylinders connected to each inlet pipe through a specific secondary conduit.

11. A process as claimed in claim 9, wherein a single-point fuel injection is performed, with the fuel being injected directly into the waste gas flow coming from an exhaust manifold common to several cylinders, and recycled in an inlet manifold common to several cylinders through a common secondary conduit.

12. A process as claimed in one of claims 9, 10, or 11, wherein said fuel injection is performed sequentially for a duration of a closing of each inlet valve.

* * * * *